US010021945B2

(12) United States Patent
Rohrbach et al.

(10) Patent No.: US 10,021,945 B2
(45) Date of Patent: Jul. 17, 2018

(54) SELF-CLOSING BUCKLE MECHANISM

(71) Applicant: Apple Inc., Cupertino, CA (US)

(72) Inventors: Matthew D. Rohrbach, Cupertino, CA (US); Peter N. Russell-Clarke, Cupertino, CA (US); Dhaval N. Shah, Cupertino, CA (US); Benjamin A. Shaffer, Cupertino, CA (US); Edward Siahaan, Cupertino, CA (US); Ying-Liang Su, Shenzhen (CN); Teodor Dabov, Cupertino, CA (US); Michael J. Webb, Cupertino, CA (US); Michael T. Brickner, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 492 days.

(21) Appl. No.: 14/641,404

(22) Filed: Mar. 8, 2015

(65) Prior Publication Data

US 2016/0037866 A1 Feb. 11, 2016

Related U.S. Application Data

(60) Provisional application No. 62/129,538, filed on Mar. 6, 2015, provisional application No. 62/036,095, filed on Aug. 11, 2014.

(51) Int. Cl.
*A44B 11/24* (2006.01)
*A41D 20/00* (2006.01)
(Continued)

(52) U.S. Cl.
CPC ..... *A44B 11/24* (2013.01); *A44C 5/14* (2013.01); *A44C 5/20* (2013.01)

(58) Field of Classification Search
CPC ..... A44C 5/14; A44C 5/20; A44B 11/24
See application file for complete search history.

(56) References Cited

U.S. PATENT DOCUMENTS 368,274 A * 8/1887 Boyd ..... A44B 11/24 24/178
858,104 A * 6/1907 Rawson ..... A44B 11/24 24/178

(Continued)

FOREIGN PATENT DOCUMENTS

BE 555150 2/1957
CH 335252 2/1959

(Continued)

*Primary Examiner* — Robert Sandy
*Assistant Examiner* — Louis A Mercado
(74) *Attorney, Agent, or Firm* — McDermott Will & Emery LLP

(57) ABSTRACT

Embodiments are directed to a wearable device including first and second band straps attached to a device body. A buckle mechanism is configured to attach the first band strap to the second band strap and includes a spring bar attached to an end of the first band strap and a buckle loop engaged to the spring bar. A tang is configured to engage a hole formed in the second band strap to secure the first band strap to the second band strap. The tang defines an aperture that receives the spring bar and is configured to pivot about an offset axis that is offset with respect to an axis of the bar. As the tang is rotated, a restoring force biases the tang toward the buckle loop.

14 Claims, 14 Drawing Sheets

SECTION B-B

(51) Int. Cl.
*A44C 5/14* (2006.01)
*A44C 5/20* (2006.01)

(56) References Cited

U.S. PATENT DOCUMENTS

| | | | | | |
|---|---|---|---|---|---|
| 956,909 | A | * | 5/1910 | Tuttle | A44B 11/24 24/163 R |
| 1,186,506 | A | * | 6/1916 | Blewett | A44B 11/24 24/163 R |
| 1,463,657 | A | * | 7/1923 | Nelson | A44B 11/24 24/188 |
| 1,525,424 | A | * | 2/1925 | King | A44B 11/24 24/163 R |
| 2,696,839 | A | | 12/1954 | Schuerhoff | |
| 2,735,152 | A | * | 2/1956 | Beuchat et al. | A44B 11/24 24/178 |
| 3,362,595 | A | | 1/1968 | Herzog | |
| 3,885,383 | A | | 5/1975 | Tanaka | |
| 4,585,037 | A | | 4/1986 | Kimbara | |
| 4,662,407 | A | | 5/1987 | Duncan | |
| 4,748,078 | A | | 5/1988 | Doi et al. | |
| 4,846,230 | A | | 7/1989 | Mock et al. | |
| 5,089,669 | A | | 2/1992 | Piper et al. | |
| 5,219,636 | A | | 6/1993 | Golz | |
| 5,437,314 | A | | 8/1995 | Sainen | |
| 5,438,851 | A | | 8/1995 | Geissbuhler | |
| 5,465,762 | A | | 11/1995 | Farley | |
| 5,529,826 | A | | 6/1996 | Tailor et al. | |
| 6,336,475 | B2 | | 1/2002 | Dewispelaere et al. | |
| 6,376,047 | B1 | | 4/2002 | Hasegawa | |
| 7,143,437 | B2 | | 11/2006 | Royer et al. | |
| 7,275,667 | B2 | | 10/2007 | Bertucci | |
| 7,836,917 | B1 | | 11/2010 | Osborne | |
| 7,909,066 | B2 | | 3/2011 | Wada | |
| 8,039,083 | B2 | | 10/2011 | Higashinaka et al. | |
| 8,603,374 | B2 | | 12/2013 | Domagalski et al. | |
| 8,651,150 | B2 | | 2/2014 | Siebert | |
| 2006/0166577 | A1 | | 7/2006 | Rashed | |
| 2013/0008554 | A1 | | 1/2013 | Fisher et al. | |
| 2014/0135906 | A1 | | 5/2014 | Winner et al. | |
| 2014/0208546 | A1 | * | 7/2014 | Lee | A44B 11/24 24/3.2 |
| 2016/0186926 | A1 | * | 6/2016 | Oberpriller | F16M 13/04 24/3.1 |
| 2016/0200563 | A1 | * | 7/2016 | Chen | B68C 1/14 24/178 |

FOREIGN PATENT DOCUMENTS

| | | |
|---|---|---|
| CN | 201546014 | 8/2010 |
| CN | 203382963 | 1/2014 |
| CN | 203513965 | 4/2014 |
| EP | 0036527 | 3/1981 |
| FR | 1217530 | 5/1960 |
| JP | 2006130167 | 5/2006 |
| JP | 2012172281 | 9/2012 |
| WO | WO2009059209 | 5/2009 |

* cited by examiner

SECTION A-A

SECTION B-B

SECTION C-C

SECTION C-C

SECTION C-C

SECTION C-C

SECTION C-C

SECTION C-C

SECTION C-C

SELF-CLOSING BUCKLE MECHANISM

CROSS-REFERENCE TO RELATED APPLICATION

This application is a nonprovisional patent application of and claims the benefit of U.S. Provisional Patent Application No. 62/036,095, filed Aug. 11, 2014 and titled "Self-Closing Buckle," and U.S. Provisional Patent Application No. 62/129,538, filed Mar. 6, 2015 and titled "Self-Closing Buckle Mechanism," the disclosures of which are hereby incorporated herein by reference in their entireties.

TECHNICAL FIELD

The embodiments disclosed herein relate to a buckle mechanism for a band or strap, and more particularly to a buckle mechanism having a biasing member or a self-closing feature.

BACKGROUND

Portable electronic devices such as watches, portable media players, mobile phones, and the like have become ubiquitous in recent years. Users carry these devices while moving in various environments during their daily activities. Modern portable electronic devices may be hand-carried by a user or they may be removably attached to the person of a user by means of straps, tethers, or other attachment systems. Many users have grown accustomed to carrying portable electronic devices while engaging in strenuous activities such as running, climbing and the like. Because users are in possession of these devices in such environments, it may be advantageous to securely fasten the device to a body part of the user to reduce the risk of the device being lost or dropped. Straps, tethers, and other attachment systems may prevent the user from dropping or losing the device and function as a convenience to the user.

Many bands use a buckle with a tang to secure one end of a band to another. The buckle may be held shut by the tension of the band strap, which typically prevents movement or disengagement of the tang. In the absence of the strap tension, the tang may freely move and the buckle may come open, permitting the band ends to disconnect. Embodiments described herein may reduce or eliminate some drawbacks associated with some traditional buckle mechanisms.

SUMMARY

Figure 1:
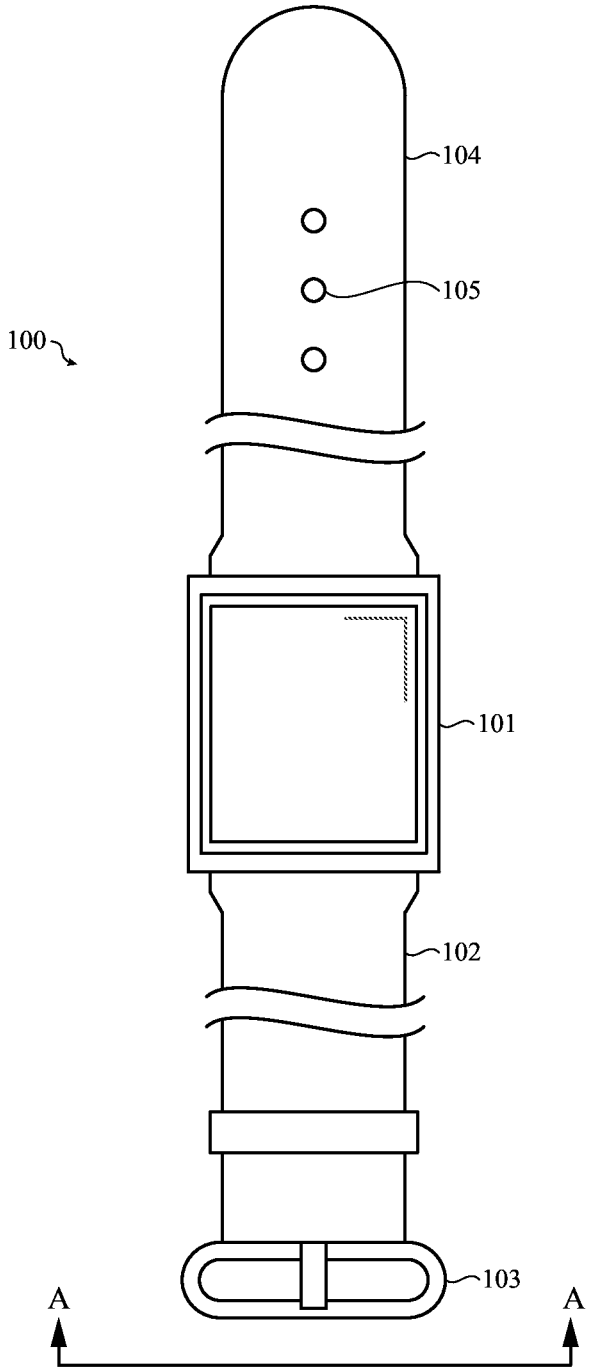
FIG. 1 depicts an attachment band having a buckle mechanism.

Embodiments described herein may be directed to a clasp or buckle mechanism for attaching a device to a user. In some embodiments, a buckle mechanism disposed at an end of a first band strap and includes a tang and buckle loop that are configured to engage or fasten to a second, mating band strap. The tang may rotate and have an end that is configured to feed through a hole or aperture in the second band strap. The tang may also be received by a notch or other feature formed into the buckle loop. In some implementations, the buckle mechanism includes a biasing member that is configured to maintain the buckle mechanism in a closed position. For example, a biasing member, spring, or other compliant element may be used to bias the tang toward the notch or mating feature of the buckle loop to help maintain engagement of the second band strap. In some cases, the wearable device is a health monitoring device, and the first and second band straps are configured to attach the health monitoring device to a wrist of a user.

Some example embodiments are directed to a buckle mechanism for a wearable device. The mechanism may include a tang disposed at an end of a first band strap. The tang may be configured to engage a hole in a second band strap. A buckle loop may be disposed at the end of the first band strap and have a notch feature that is configured to receive an end of the tang when the buckle mechanism is closed. A biasing member may be configured to bias the tang toward the notch feature.

In some embodiments, a spring bar is attached to the end of the first band strap. The tang may wrap around the spring bar. For example, the tang may define an aperture that receives the spring bar. In some embodiments, the tang is configured to pivot about an offset axis that is offset with respect to an axis of the spring bar. In some implementations, the biasing member is formed from an elastic material disposed between the spring bar and a side wall of the aperture. The elastic material may be configured to compress when the tang is pivoted away from the notch feature in the buckle loop. In some implementations, the biasing member may include the spring bar, which is configured to bend when the tang is pivoted away from the notch feature formed in the buckle loop.

In some embodiments, the biasing member includes a tab disposed relative to an upper surface of the tang. The tab may be configure to resist movement of the tang away from the notch feature formed in the buckle loop. In some cases, the tang is integrally formed with the first band strap and a living hinge is formed at a junction between the tang and the first band strap. The living hinge may be configured to repeatedly bend along a bend line.

In some embodiments, a first portion of the first band strap forms a top portion of the tang and a second portion of the first band strap forms a bottom portion of the tang. The biasing member may include a spring layer is disposed between the top portion of the tang and the bottom portion of the tang.

In some embodiments, a spring bar is attached to the end of the first band strap. The tang may define an aperture that receives the spring bar and the tang may be configured to pivot about the spring bar. In some cases, the biasing member may include a torsional spring including: a coil portion at least partially wrapped about the spring bar; a first leg portion that is fixed with respect to the buckle loop; and a second leg portion that is fixed with respect to the tang.

In some embodiments, the biasing member includes a spiral portion of the buckle loop. The spiral portion may includes a spiral-shaped cut formed into the buckle loop. The spiral portion may be coupled to the tang and is may configured to twist as the tang is rotated.

Some example embodiments are directed to a self-closing buckle mechanism that includes a bar disposed at an end of a band strap and a tang defining an aperture that receives the bar. The tang may be configured to pivot about an offset axis that is offset with respect to an axis of the bar. A buckle loop may be disposed at the end of the band strap and have a recess that receives an end of the tang. In some cases, as the tang is rotated away from the recess, a restoring force biases the tang toward the recess. In some implementations, an insert member is disposed within the aperture. The insert member may be configured to generate the restoring force biasing the tang toward the recess. The insert member may be formed from an elastic material and the elastic material may deforms when the tang is pivoted away from the recess. In some cases, the insert member is formed from two or more elastic materials, and the two or more elastic materials have different elastic properties.

In some embodiments, the buckle loop includes a bearing sleeve portion. The tang may include a cylindrical portion that pivotally engages the bearing sleeve portion of the buckle loop. The tang may be configured to pivot about the offset axis defined by the cylindrical portion. In some embodiments, the aperture is a clearance fit with respect to the bar, and the bar is configured to bend in response to a rotational movement of the tang.

Some example embodiments are directed to a wearable electronic device including a body, a first band strap attached to a first portion of the body, and a second band strap attached to a second portion of the body. A buckle mechanism may be configured to attach the first band strap to the second band strap. The buckle mechanism may include a spring bar attached to an end of the first band strap and a buckle loop engaged to the spring bar. A tang may be configured to engage a hole formed in the second band strap to used secure the first band strap to the second band strap. The tang may define an aperture that receives the spring bar. The tang may be configured to pivot about an offset axis that is offset with respect to an axis of the bar. As the tang is rotated, a restoring force may bias the tang toward the buckle loop. In some cases, the restoring force maintains engagement of the tang within the hole of the second band strap.

In some embodiments, an elastic material is disposed between the spring bar and a side wall of the aperture. In some cases, the elastic material is configured to deflect in response to the tang being pivoted away from the buckle loop and provide the restoring force. In some embodiments, the spring bar is configured to bend when the tang is pivoted away from the buckle loop and provide the restoring force.

DETAILED DESCRIPTION

Reference will now be made in detail to representative embodiments illustrated in the accompanying drawings and in particular with reference to FIGS. 1-14. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims. Those skilled in the art will readily appreciate that the detailed description given herein with respect to these Figures is for explanatory purposes only and should not be construed as limiting. Like reference numerals denote like structure throughout each of the various figures.

Embodiments described herein may be directed to a clasp or buckle mechanism for attaching a device to a user. In some embodiments, a buckle mechanism disposed at an end of a first band strap and includes a tang and buckle loop that are configured to engage or fasten to a second band strap. The tang may rotate and have an end that is configured to feed through a hole or aperture in the second band strap. The tang may also be received by a notch or other feature formed into the buckle loop. In some implementations, the buckle mechanism includes a biasing member that is configured to maintain the buckle mechanism in a closed position. For example, a spring or other compliant element may be used to bias the tang toward the notch or mating feature of the buckle loop to help maintain engagement of the second band strap.

The embodiments described herein may be used in a variety of attachment systems. For example, the buckle mechanism may be used to secure a first attachment component, including a strap, band, lanyard, or other attachment component to a mating attachment component. The buckle mechanism may secure the attachment components to each other in order to attach a device to another object, such as the body of a user. For example, the buckle mechanism may be used to attach two band straps together in order to secure a wearable electronic device (e.g., a watch) to the wrist of a user. While some examples are provided with respect to wrist-worn wearable device, the principles of the buckle mechanism may be applied to a variety of attachment systems.

FIG. 1 depicts an example device 100 having a buckle mechanism 103. In particular, FIG. 1 depicts a wearable electronic device 100 which may include a watch, smart watch, time-keeping device, wearable health monitoring device, and the like. In other embodiments, the device may include a computing device, a mobile phone, a portable media player, tablet computing device, and so on. As shown in FIG. 1, the device 100 may include an attachment system (e.g., band straps 102, 104) that are configured to attach the device 100 to an object, such as a body part of the user.

As shown in FIG. 1, the device 100 includes a device body 101 attached to a first band strap 102 and a second band strap 104. In particular, one end of first band strap 102 is attached to a first portion of the device body 101 and one end of the second band strap 104 is attached to a second portion of the device body 101 that is opposite to the first portion. The band straps 102, 104 may be attached to the device body 101 by a pin, bar, or other attachment member. In some embodiments, the band straps 102, 104 are removably attached to the device body 101. In some embodiments, band straps 102, 104 are integrally formed with the device body 101.

The band straps 102, 104 may be formed from a flexible or bendable material that may be wrapped around a body part of the user. In some cases, the band straps 102, 104 may be formed from a textile material that includes natural or synthetic fibers or threads that are woven or otherwise interconnected to form the textile. In some cases, the band straps 102, 104 may be formed from a metallic material, including for example, a metallic mesh, metallic weave, metallic link, or other metallic construction. In some cases, the band straps 102, 104 may be formed from a natural or synthetic leather material. The band straps 102, 104 may also be formed from a polymer, elastomer, polyurethane, natural rubber, and so on. In some cases, the band straps 102, 104 are a composite of multiple materials.

As shown in FIG. 1, the first band strap 102 includes a buckle mechanism 103 disposed at a free end of the first band strap 102. As described in more detail below, the buckle mechanism 103 may include a tang and a buckle loop that are configured to engage the free end of the second band strap 104 to attach the device 100 to an object, such as a user's wrist. The buckle mechanism 103 is configured to receive a free end of the second band strap 104, which may be pulled through the buckle loop and tighten the band straps 102, 104 with respect to each other. In some implementations, a tang of the buckle mechanism 103 is configured to engage a hole 105 or aperture formed in the second band strap 104 to secure the first band strap 102 to the second band strap 104. When the first 102 and second 104 band straps are attached, they may form a band loop that encircles or wraps around an object, such as the user's wrist. As shown in FIG. 1, the second band strap 104 includes a series of holes 105 that can be used to adjust the size of the band loop.

In some embodiments, the buckle mechanism 103 is configured to provide a biasing force to maintain the engagement between the buckle mechanism 103 and the second band strap 104. In accordance with some embodiments described in more detail below with respect to FIGS. 2-14, the buckle mechanism may include a spring, biasing member, or other component that produces a biasing force on the tang of the buckle mechanism 103 to maintain the engagement of the tang with a corresponding hole 105 or aperture formed in the second band strap 104.

Figure 2:
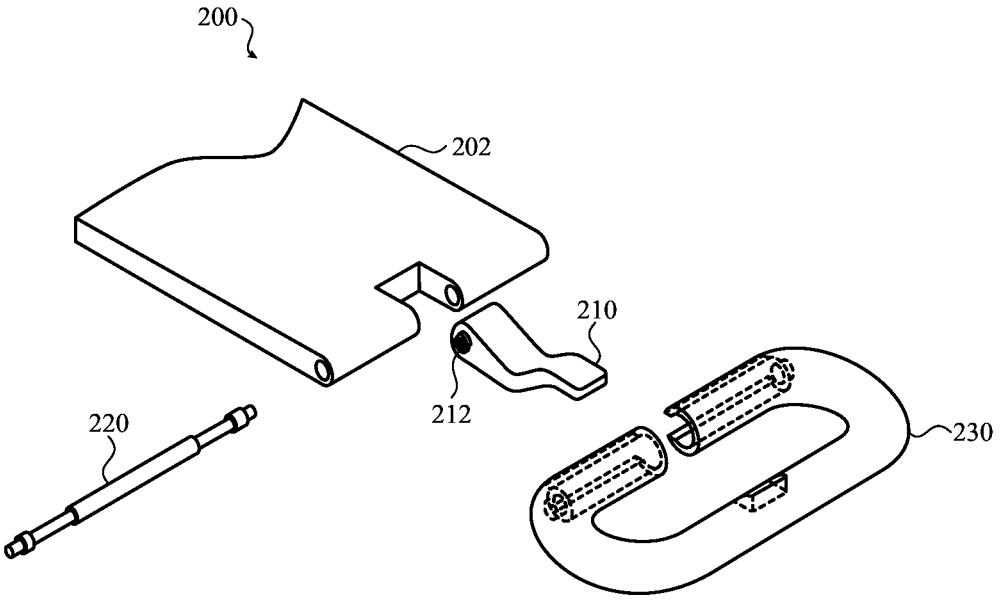
FIG. 2 depicts an exploded view of an example buckle mechanism.

FIG. 2 depicts an exploded view of an example buckle mechanism 200. The buckle mechanism of FIG. 2 may correspond to the buckle mechanism 103 described above with respect to FIG. 1. In particular, the buckle mechanism 200 of FIG. 2 may be disposed at the end of a first band strap 202 and used to attach the first band strap 202 to a second band strap. As discussed above with respect to FIG. 1, the second band strap may include a hole or aperture for receiving a tang 210 of the buckle mechanism 200. In some embodiments, the buckle mechanism 200 includes a component or feature that biases the tang 210 in a direction to maintain the engagement between the tang 210 and the second band strap.

As shown in FIG. 2, the buckle mechanism 200 includes a spring bar 220 disposed at an end of the band strap 202. In some embodiments, the spring bar 220 may be attached to the band strap 202 via a loop or hole formed into the end of the band strap 202. In some embodiments, the spring bar 220 is integrally formed with the band strap 202. The spring bar 220 may pivotally couple to the band strap 202, or alternatively, the spring bar 220 may remain fixed with respect to the band strap 202.

The spring bar 220, also referred to as simply a bar or a pin, may include a generally cylindrically-shaped body having a spring-loaded post extending from each end of the body. The spring-loaded posts may be configured to compress or withdraw into the body of the spring bar 220 when pressed. Then released, spring-loaded posts may then extend and engage a corresponding feature formed in a mating part. In the example depicted in FIG. 2, the posts of the spring bar 220 may be compressed into the body to assemble the spring bar 220 to the buckle loop 230. When the spring bar 220 is in the assembled position (see, e.g., FIG. 3), the posts of the spring bar 220 may extend outward and engage a corresponding recess, hole, or aperture formed in the buckle loop 230.

As shown in FIG. 2, the spring bar 220 may also be received by an aperture 212 formed within or defined by the tang 210. In the present embodiment, the tang 210 wraps around and is pivotably coupled to the spring bar 220. For example, the tang 210 may be able to rotate or pivot with respect to the spring bar 220. In some implementations, the tang 210 may pivot about the spring bar 220 but does not rotate on the same axis as the spring bar 220. In some implementations, the tang 210 rotates about an axis that is offset with respect to the spring bar 220.

The buckle mechanism 200 of FIG. 2 also includes a buckle loop 230 which is disposed at the end of the band strap 202. In the present embodiment, the buckle loop 230 is attached to the spring bar 220, which is held in a loop or feature formed in the end of the band strap 202. The buckle loop 230 may be pivotably coupled to the spring bar 220 such that the buckle loop 230 is able to rotate a few degrees with respect to the end of the strap 202. As shown in FIG. 2, the buckle loop 230 is formed about or at least partially surrounds the tang 210. The buckle loop 230 also includes a notch, recess, or other feature for receiving the end of the tang 210 when the buckle is closed.

Figure 3:
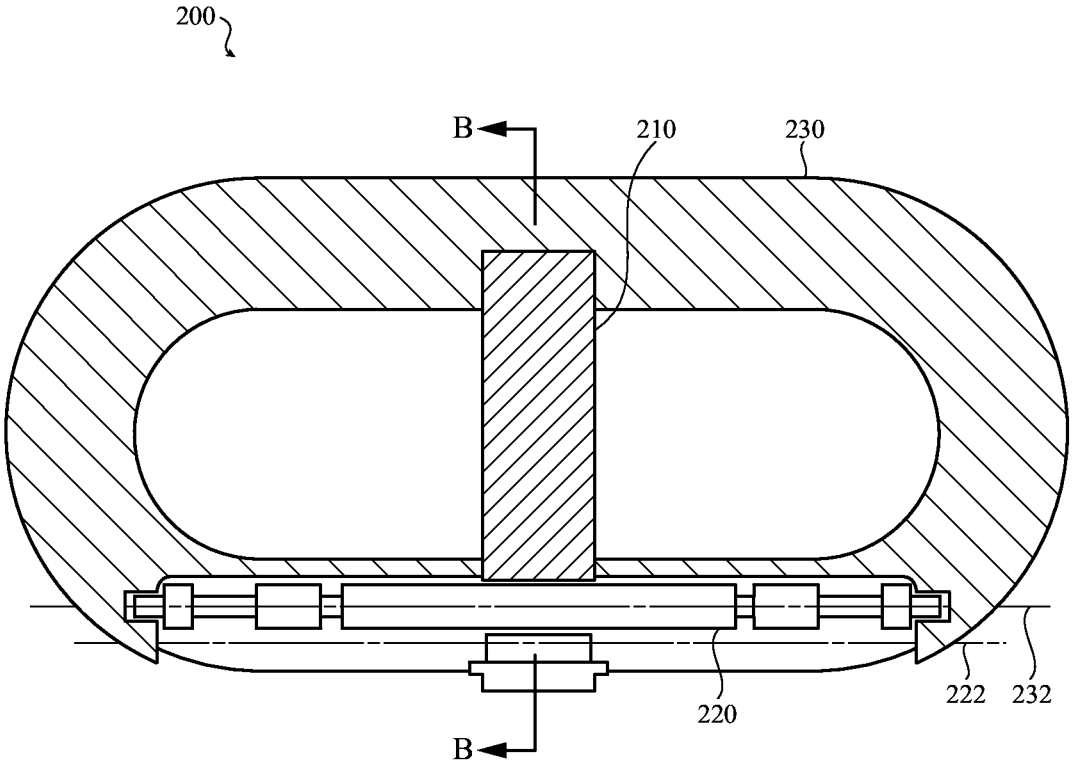
FIG. 3 depicts a cross-sectional view of the example buckle mechanism along section A-A.

FIG. 3 depicts a cross-sectional view of the example buckle mechanism 200 along section A-A of FIG. 1. FIG. 3 depicts an example tang 210 that rotates about an offset axis 232 which is offset with respect to axis 222 of the spring bar 220. In the present embodiment, the axis 232 of rotation of the tang 210 is also aligned with an axis of a (rear) portion of buckle loop 230 located proximate to the tang 210. While the alignment of the tang 210 rotation with respect to a portion of the buckle loop 230 is not necessary, it may be advantageous in order to prevent the creation of gaps between the tang 210 and the buckle loop 230 as the tang 210 is rotated.

The offset between the offset axis 232 of the tang 210 and the axis 222 of the spring bar 220 may be advantageous from more than one aspects. In particular, the offset between the axes 232, 222 may provide for an attachment of the band strap toward the rear or periphery of the buckle loop 230, which may increase or improve the amount rotation that the buckle mechanism 200 may have with respect to the band strap. The offset spring bar location depicted in FIG. 3 may also enhance the aesthetic appearance of the buckle mechanism 200 by reducing overlap between the band strap and the buckle loop 230 of the buckle mechanism 200.

Figure 4:
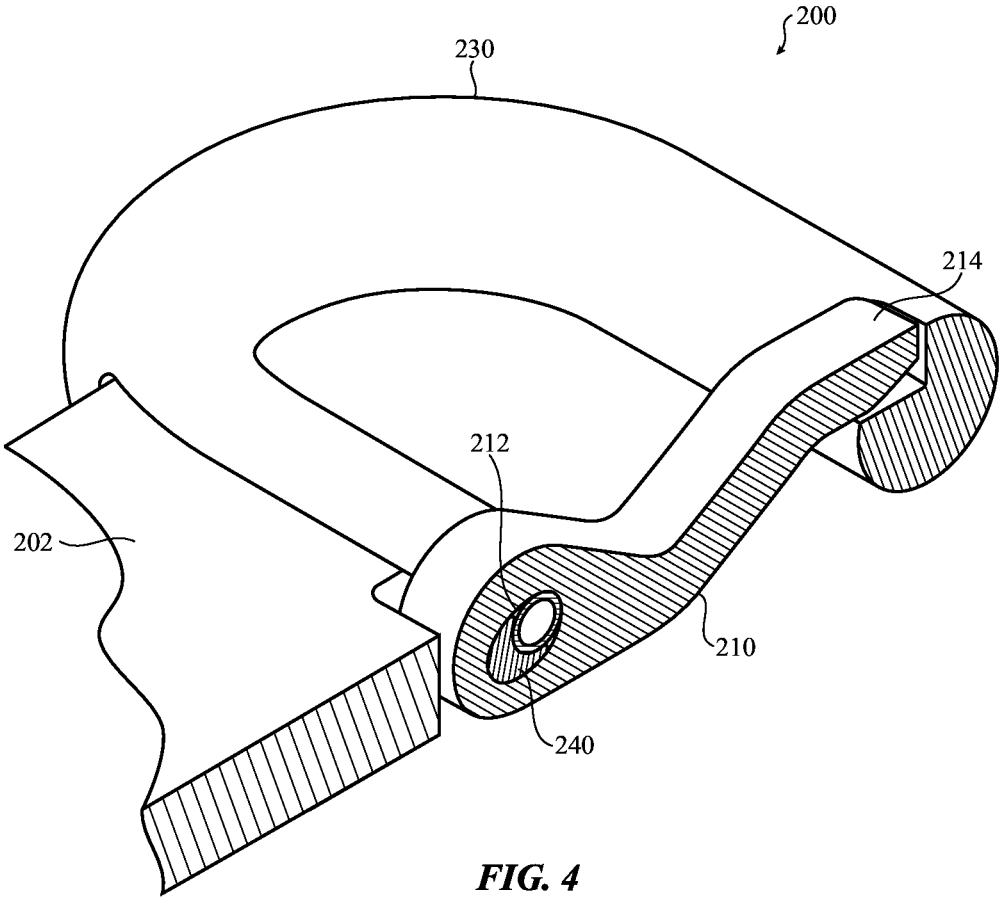
FIG. 4 depicts a cross-sectional view of the example buckle mechanism along section B-B, illustrating the relative positions of the spring bar and insert member.
Figure 5:
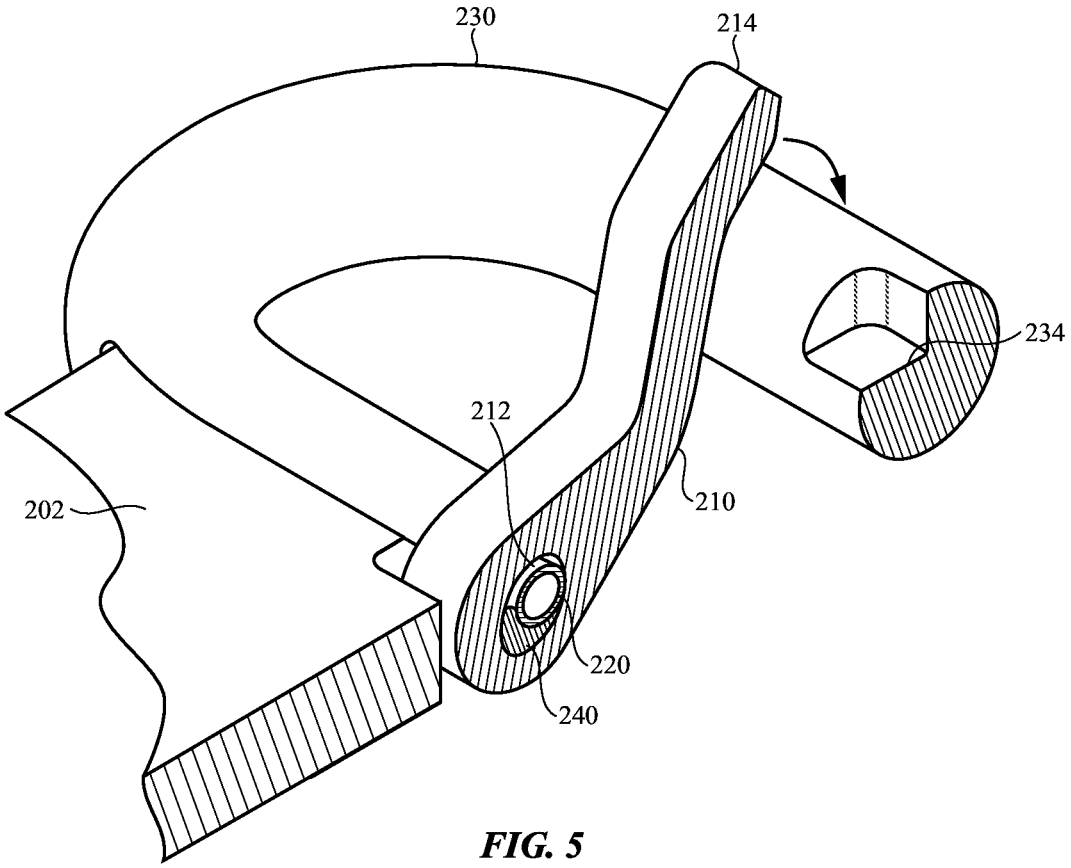
FIG. 5 depicts a cross-sectional view of the example buckle mechanism along section B-B, with the tang in an open position.

Another advantage of having an offset between the axis 232 of the tang 210 and the axis 222 of the spring bar 222, as depicted in FIG. 3, is that the an insert member or other element may be used to create a bias force on the tang 210. FIGS. 4-5 depict a cross-sectional views of the buckle mechanism 200 including an example insert member 240. In the present example, the insert member 240 is disposed at least partially within the aperture 212 of the tang 210. A portion of the insert member 240 is also disposed in a space between the wall of the aperture 212 and the spring bar 220.

In the present example, the insert member 240 provides a bias force that may help maintain the buckle mechanism 200 in a closed position. In particular, as shown in FIG. 5, a rotation or pivoting of the end 214 of the tang 210 upward or away from a notch feature 234 in the buckle loop 230 may deform and/or compress the insert member 240. The deformation and/or compression of the insert member 240 may create a rotational moment on the tang 210, which may bias the end 214 of the tang 210 back toward the notch feature 234 in the buckle loop 230. In some cases, the insert member 240 is partially deflected or pre-loaded when the tang 210 is in a closed or downward position. In some cases, the bias provided by the insert member 240 facilitates continued engagement between the end 214 of the tang 210 and a hole or aperture formed in a mating band strap that has been inserted in the buckle mechanism 200.

In some implementations, the insert member 240 creates an intentional interference between the tang 210 and other stationary components of the buckle mechanism 200. In the present embodiment, the insert member 240 is compressed between the walls of the aperture 212 of the tang 210 and the spring bar 220, which is received by the aperture 212. In the present example, the offset between the axis of the spring bar 220 and the (offset) axis rotation of the tang 210 results in the distortion and/or compression of the insert member 240. Because the insert member 240 is elastic or resilient, the distortion of the insert member 240 may result in a bias or return force on the tang 210.

In an alternative embodiment, the axes of the spring bar 220 and the tang 210 may be aligned and the insert member 240 provides a restoring or biasing force due to a twisting or torsional deflection of the insert member. For example, the outside perimeter of the insert member 240 may be mechanically engaged (via adhesion, friction, or the like) with the side wall of the aperture 212. An inside perimeter of the insert member may also be engaged with a portion of the spring bar 220 such that a rotation of the tang 210 with respect to the spring bar 220 results in a twisting, torsional displacement, or similar distortion of the insert member 240. Similar to the previous examples, a distortion of the insert member 240, which is elastic in nature, may generate a biasing or return force on the tang 210.

The insert member 240 may be formed from an elastic or resilient material, including, for example, a polymer, elastomer, rubber, and the like. In some implementations, the insert member 240 is formed from two or more types of elastic materials. For example, the insert member may be formed from a first elastomer and a second elastomer that is over-molded or insert molded onto the first elastomer. The first and second elastomers may have different elastic properties to form a dual-compound insert member. Dual compound insert members may, in some examples, provide an easier initial resistance to a tang rotation due to one or more (softer) elastomers, which may progress into an increasing resistance to further tang rotation due to one or more other (harder) elastomers.

In some embodiments, the shape of the insert member 240 may be configured to produce a particular biasing force profile as the tang 210 is rotated. For example, in some embodiments, the insert member 240 may be shaped such that no biasing or closing force is exerted on the tang 210 until the tang 210 rotates to a certain point or after it rotates past a certain point. In some cases, this may increase the ease with which a user might buckle or unbuckle the band straps from each other.

In some embodiments, the rotation of the tang 210 is determined by a feature formed into the buckle loop 230. For example, the buckle loop 230 may include a bearing sleeve portion formed at the opening in the buckle loop 230 that receives the tang 210. The tang 210 may have a corresponding cylindrical portion that pivotally engages the bearing sleeve portion of the buckle loop 230, which may rotationally constrain the tang 210 to rotate about a particular axis (e.g., axis 232 of FIG. 3). An example sleeve bearing and cylindrical portion are depicted and described in more detail below with respect to FIGS. 6-8.

As shown in FIGS. 4-5 the buckle loop 230 may include a notch feature 234 that is configured to receive the end 214 of the tang 210. The notch feature 234 may include a dimple, pocket, groove, or other type of recess that is configured to accept a portion of the end 214 of the tang 210. In some embodiments, the notch feature 234 is configured to support and center the tang 210 within the buckle mechanism 200. For example, the notch feature 234 may prevent or reduce lateral movement of the tang 210 within the buckle loop 230, which may enhance the engagement between the tang 210 and a hole or aperture formed in a mating band strap.

Figure 6:
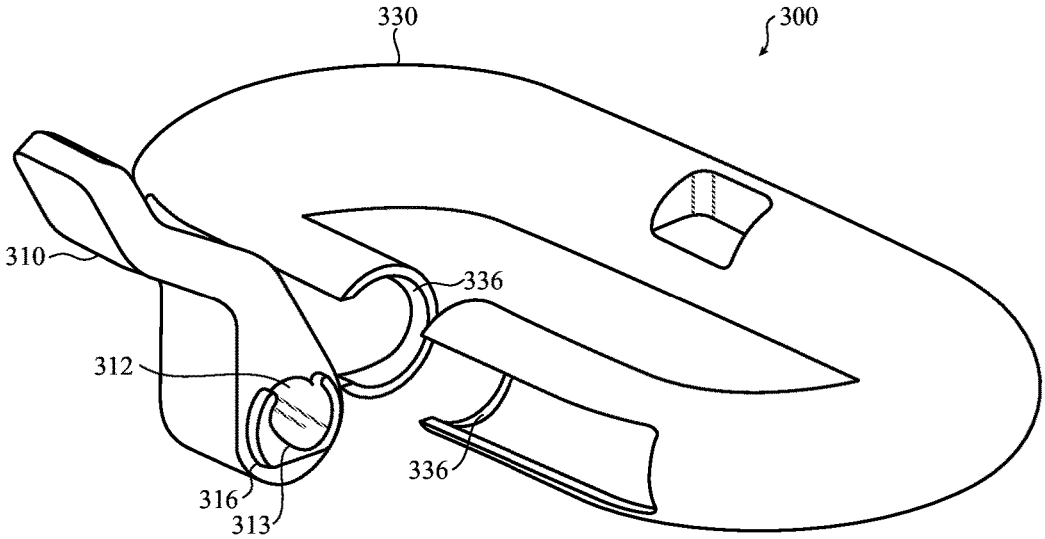
FIG. 6 depicts an exploded view of a buckle mechanism.
Figure 7:
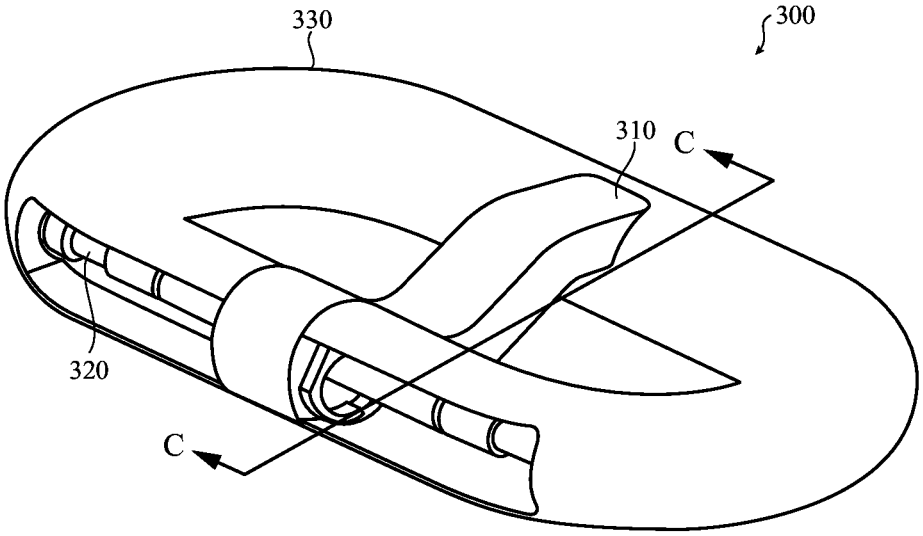
FIG. 7 depicts the buckle mechanism with a partial cutaway to illustrate a position of the spring bar.
Figure 8:
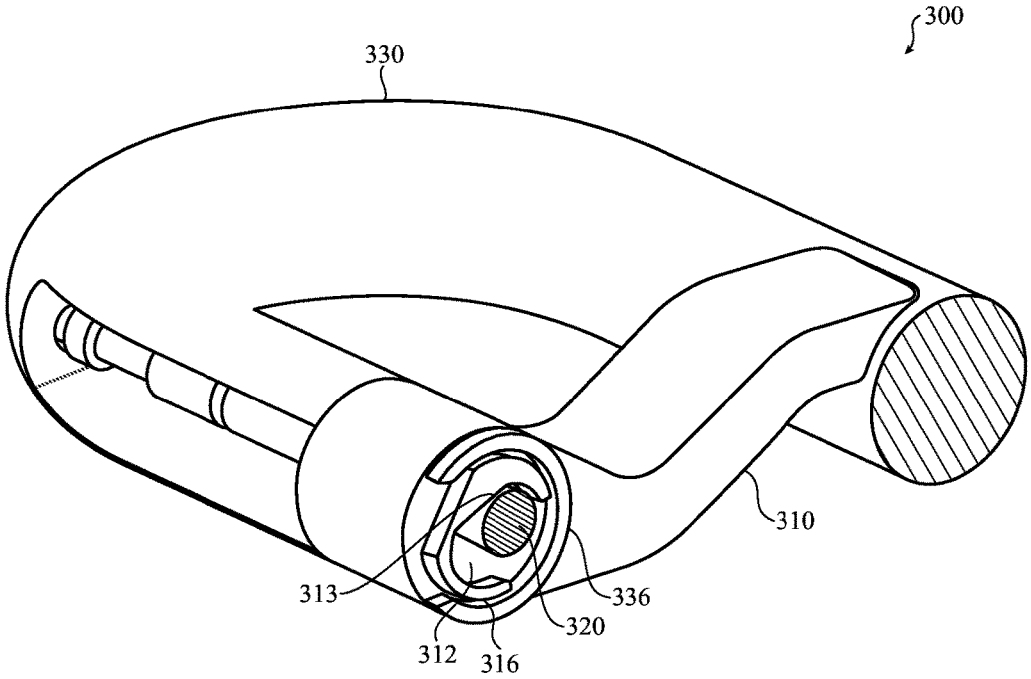
FIG. 8 depicts a cross-sectional view of a buckle mechanism along section C-C.

FIGS. 6-8 depict an alternative embodiment of a self-closing buckle mechanism 300. In the examples of FIGS. 6-8, the spring bar 320 is configured to deflect in response to a rotation of the tang 310 within the buckle mechanism. FIG. 6 depicts a partial view of the buckle mechanism 300 during assembly. FIG. 7 depicts a partial view of the buckle mechanism 300 assembled with the tang 310 closed. FIG. 8 depicts a cross-sectional partial view of the buckle mechanism 300 with the tang 310 closed. The embodiment depicted in FIGS. 6-8 may correspond to the buckle mechanism described above with respect to FIGS. 1-3.

Similar to the example described above with respect to FIG. 3, in the examples of FIGS. 6-8, the axis of the spring bar 320 is offset with respect to rotational axis of the tang 310. The offset axis of the spring bar 320 with respect to the tang 310 may be used create a biasing or restoring force that maintains the buckle mechanism 300 in a closed position. In some embodiments, the offset spring bar 320 helps to maintain engagement between the tang 310 and a corresponding hole or aperture of a mating strap.

As shown in FIGS. 6-8, the tang 310 defines an aperture 312 having an inner wall that is configured to engage the spring bar 320 as the tang 310 is rotated. In some embodiments, the inner wall of the aperture 312 has a ramp portion 313 that is configured to make sliding contact with the spring bar 320 and deflect the spring bar 320 as the tang 310 is rotated. As shown in FIGS. 6-8, the ramp portion 313 may include a region of the inner wall of the aperture 312 that is closer to the center of axis of rotation of the tang 310 as compared to other regions of the inner wall of the aperture 312. In some cases, the ramp portion 313 is positioned relative to the location of the spring bar 320 such that movement (rotation or pivoting) of the tang 310 in an upward direction away from the buckle loop 330 cause the ramp portion 313 to gradually deflect the spring bar 320. In some cases, the ramp portion 313 partially deflects or pre-loads the spring bar 320 even when the tang 310 is in a downward or closed position.

Thus, in the embodiments of FIGS. 6-8, the spring bar 320 functions as a biasing member that is configured to provide a biasing or return force for the tang 310 of the buckle mechanism 300. In particular, as the inner wall of the aperture 312 deflects the spring bar 320, the spring bar 320 may be formed from a resilient material that produces a restoring force in response to the deflection, which in turn biases the tang downward or toward the buckle loop 330. In some cases, the spring bar 320 is formed from a compliant metal material and is configured to deflect without yielding throughout the rotation of the tang 310. In some embodiments, the spring bar 320 is formed from a steel, stainless steel, aluminum, brass, or other metallic material. In some embodiments, the spring bar 320 comprises a plastic, elastomer, or polymer material.

Similar to the previous example described above, the tang 310 may be configured to engage one or more features of the buckle loop 330 to define the axis of rotation of the tang 310. In some cases, to maintain the appearance of the tang 310 while it rotates (e.g., to prevent the tang from becoming off-center with respect to the buckle during rotation), bearing surfaces may be defined within the buckle loop 330. For example, the buckle loop 330 may include a bearing sleeve portion 336 formed at the opening in the buckle loop 330 that receives the tang 310. The tang 310 may have a corresponding cylindrical portion 316 that pivotally engages the bearing sleeve portion 336 of the buckle loop 330, which may rotationally constrain the tang 310 to rotate about a particular axis (e.g., axis 232 of FIG. 3). In the examples depicted in FIGS. 6-8, the tang 310 includes two cylindrical portions 316, which pivotally engage with two corresponding bearing sleeve portions 336 formed at the ends of the buckle loop 330.

In some cases, the cylindrical portion 316 of the tang 310 and ramp portion 313 of the aperture 312 together define how the spring bar 320 deflects as the tang 310 rotates. For example, as shown in FIGS. 6-8, as the tang 310 rotates, the cylindrical portions 316, which are rotationally constrained by the bearing sleeves 336 of the buckle loop 330 help drive the ramp portion 313 into the spring bar 320. The cylindrical portions 316 guided by the bearing sleeves 336 maintain rotation about an axis of the tang 310 despite the fact that the spring bar 320 extends through the aperture 312 of the tang 310 along an offset axis.

The interaction between the tang 310 and the spring bar 320 bends the spring bar 320, as described above, resulting in a restoring force that seeks to return the tang to a closed position with the end of the tang 310 resting against the buckle loop 330, as shown in FIG. 7. In some embodiments, the configuration depicted in FIGS. 6-8 has an additional advantage that any force exerted on the tang 310 is transferred to the buckle loop 330 and not to the spring bar 320. In some cases, this may increase the overall amount of force to which the buckle mechanism 300 can be subjected to before a component breaks or fails. This is particularly true for configurations in which the buckle loop 330 and tang 310 have superior strength as compared to the narrower spring bar 320.

Figure 9:
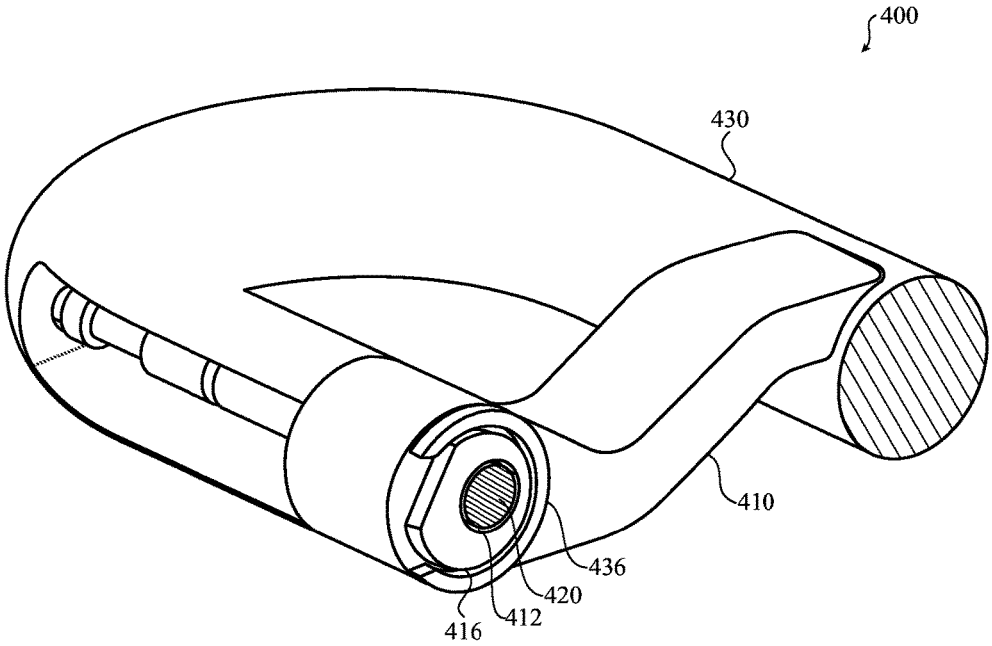
FIG. 9 depicts a cross-sectional view of an alternative buckle mechanism along section C-C, having a flexible spring bar.

FIG. 9 depicts a cross-sectional view of an alternative buckle mechanism 400 along section C-C, having a flexible spring bar 420. The embodiment depicted in FIG. 9 may correspond to the buckle mechanism described above with respect to FIGS. 1-3. Also, similar to the example described above with respect to FIG. 3, in the embodiment of FIG. 9, the axis of the spring bar 420 is offset with respect to rotational axis of the tang 410. The offset axis of the spring bar 420 with respect to the tang 410 may be used create a biasing or restoring force that maintains the buckle mechanism 400 in a closed position. In some embodiments, the offset spring bar 420 helps to maintain engagement between the tang 410 and a corresponding hole or aperture of a mating strap.

As shown in FIG. 9, the spring bar 420 is received by an aperture 412 formed or defined by the tang 410. As shown in FIG. 9, the tang 410 wraps around the spring bar 420. In the present example, the aperture 412 is a hole that is slightly larger than the outer diameter of the spring bar 420. In some cases, the aperture 412 is sized to allow for a clearance fit between the tang 410 and the spring bar 420 such that the tang 410 can rotate with respect to the spring bar 420 without binding or catching. In some embodiments, the clearance between the walls of the aperture 412 and the spring bar 420 may range between 0.1 mm and 1.0 mm for a spring bar 420 having a diameter of approximately 2 mm.

Similar to the examples described above with respect to FIGS. 6-8, the spring bar 420 of FIG. 9 is configured to bend or deflect as the tang 410 is rotated about its axis. In particular, because the spring bar 420 is offset with respect to the rotational axis of the tang 410, a portion of the side walls of the aperture 412 will contact the spring bar 420 and force the spring bar 420 to bend or deflect as the tang 410 is rotated. The spring bar 420 may be compliant and generate a restoring force in response to the deflection, which may bias the tang 410 downward or toward the buckle loop 430. In some cases, the aperture 412 of the tang 410 partially deflects or pre-loads the spring bar 420 even when the tang 410 is in a downward or closed position. Also similar to the examples of FIGS. 6-8, the axis of rotation of the tang 410 may be determined by one or more bearing features formed into the buckle loop 430.

FIGS. 10-14 depict alternative buckle mechanisms that may use different types of biasing members to bias the tang of the mechanism toward the buckle loop. Similar to the other examples described above, the biasing or restoring force may help to maintain the buckle mechanism in a closed position and help to maintain the engagement between the buckle mechanism and a mating band strap or other attachment component. In each of the embodiments of FIGS. 10-14, the spring bar may be aligned or offset with respect to an axis of rotation of the tang. In some cases, the embodiments of FIGS. 10-14 may be combined with one or more features of the buckle mechanisms described above with respect to FIGS. 3-9.

Figure 10:
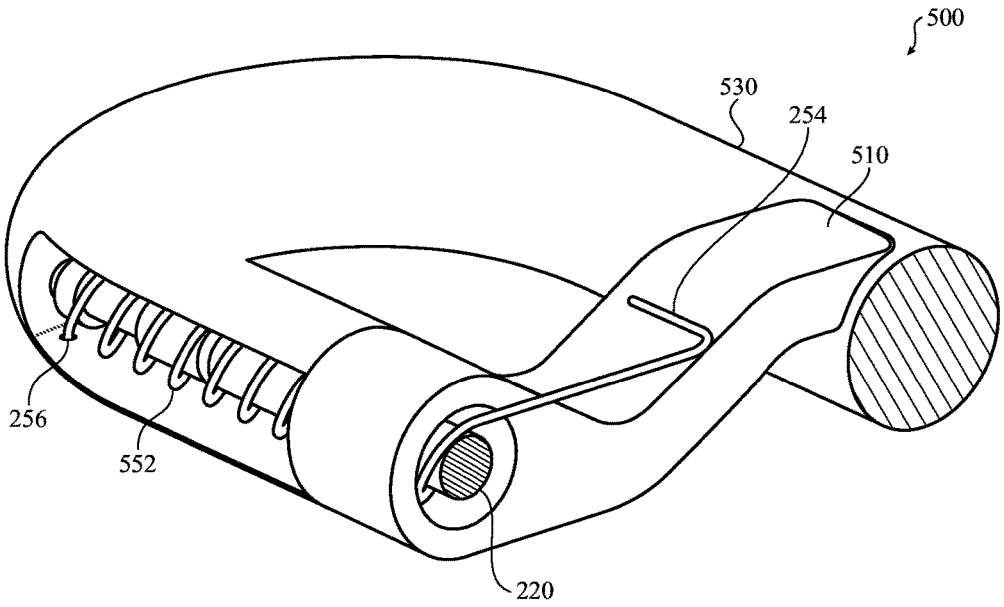
FIG. 10 depicts a cross-sectional view of an alternative buckle mechanism along section C-C, having a torsional spring.

FIG. 10 depicts a cross-sectional view of an alternative buckle mechanism 500 along section C-C, having a torsional spring 552. In the configuration of FIG. 10, the torsional spring 552 may function as a biasing member by providing a restoring or biasing force on the tang 510. In particular, as the tang 510 is pivoted upward or away from the buckle loop 530, the torsional spring 552 may deflect or twist resulting in a biasing or restoring force being applied to the tang 510. In some embodiments, the torsional spring 552 is pre-loaded and provides a biasing force on the tang 510 even when the tang 510 is in the closed position.

As shown in FIG. 10, a coil portion of the torsional spring 552 may be wound or wrapped around a portion of the buckle mechanism 500. As shown in FIG. 10, the coil portion of the torsional spring 552 may be wound around the spring bar 520 internal to the buckle loop 530. Alternatively, the coil portion of the torsional spring 552 may be located exterior to the buckle loop 530 or in a different location than as shown in FIG. 10. While one torsional spring 552 is depicted in FIG. 10, more than one torsional spring may be arranged within the buckle mechanism 500 in other embodiments.

As shown in FIG. 10, a first leg portion 556 of the spring 552 may extend toward the band and be attached or fixed with respect to the end of the band. In an alternative embodiment, the first leg portion 556 of the spring 552 may extend toward a portion of the buckle loop 530 and be fixed with respect to the buckle loop 530. Also, as shown in FIG. 10, a second leg portion 554 of the spring 552 may extend over or along the tang 510. In the present embodiment, the second leg portion 554 engages a top surface of the tang 510 to provide the restoring or biasing force. In alternative embodiments, the second leg portion 554 may be formed into the tang 510, embedded within the tang 510, or otherwise hidden from view.

Figure 11:
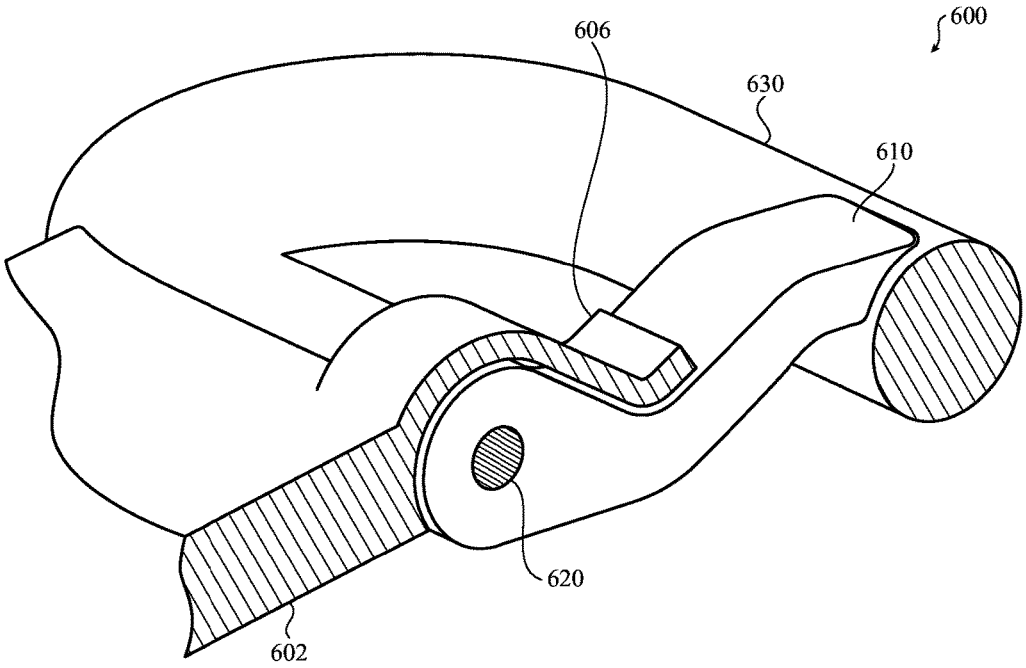
FIG. 11 depicts a cross-sectional view of an alternative buckle mechanism along section C-C, having an over-molded portion.

FIG. 11 depicts a cross-sectional view of an alternative buckle mechanism 600 along section C-C, having an over-molded portion. In the configuration of FIG. 11, a tab 606 may function as a biasing member by providing a restoring or biasing force on the tang 610. In particular, as the tang 610 is pivoted upward or away from the buckle loop 630, the tab 606 may deflect or bend resulting in a biasing or restoring force being applied to the tang 610. In some embodiments, the tab 606 slightly deformed or pre-loaded when the tang 610 is in a downward or closed position and provides a biasing force on the tang 610 even when the buckle mechanism 600 is closed.

As shown in FIG. 11, the tab 606 is positioned over an upper or top surface of the tang 610. In alternative embodiments, the tab 606 may be formed over multiple surfaces or partially encapsulate the tang 610. Also, while the tab 606 is represented as having a substantially uniform thickness for purposes of illustration, in some embodiments, the thickness of the tab 606 may vary along its length and it may have one or more contoured or shaped surfaces. As shown in FIG. 11, the tab 606 may be integrally formed with the band strap 602. In some embodiments, the tab 606 may be formed as part of an over-molding process or co-molding process with the band strap 602.

Figure 12:
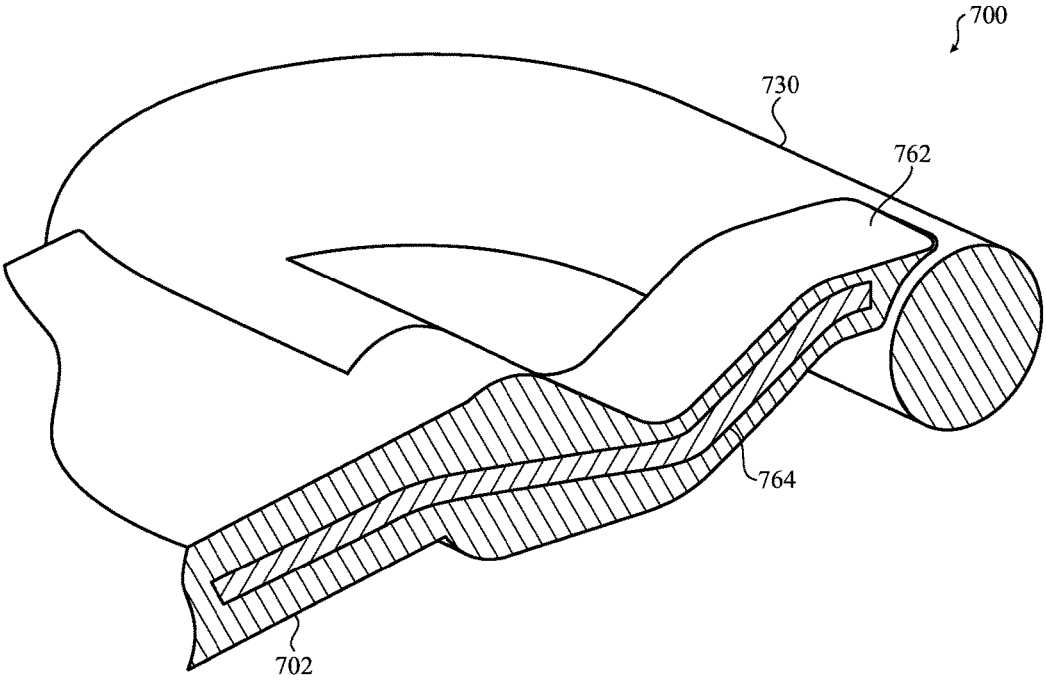
FIG. 12 depicts a cross-sectional view of an alternative buckle mechanism along section C-C, having a band strap with an integrated tang.

FIG. 12 depicts a cross-sectional view of an alternative buckle mechanism 700 along section C-C, having a band strap 702 with an integrated tang 762. In the configuration of FIG. 12, the integrated tang 762 may include or function as a biasing member and provide a restoring or biasing force to maintain a closed position of the tang 762. In particular, as the integrated tang 762 is pivoted upward or away from the buckle loop 730, integrated tang 762 itself may deflect or bend resulting in a biasing or restoring force being applied to the tang 762. In some embodiments, the tang 762 slightly deformed or pre-loaded when the tang 762 is in a downward or closed position and provides a biasing force even when the buckle mechanism 700 is closed.

As shown in FIG. 12, the integrated tang 762 is integrally formed with the band 702. In some embodiments, the tang 762 is formed as part of the same molding process as the formation of the band 702. In some embodiments, the tang 762 is over-molded or co-molded with the band 702. In some embodiments, the integrated tang 762 includes a spring layer 764. The spring layer 764 may be integrally formed into the tang 762 as part of the over-molding or co-molding process. The spring layer 764 may be formed from a sheet of spring steel, steel, or other metal material. As shown in FIG. 11, a portion of the spring layer 764 may extend into the band 702 and a portion of the spring layer 764 may extend into a portion of (or through all of) the tang 762.

In the embodiment of FIG. 12, the tang 762 may be formed from three or more layers. In particular, a first portion or layer of the band strap 702 may form a top portion of the tang 762. A second portion or layer of the band strap may form a bottom surface of the tang. In the buckle mechanism 700 depicted in FIG. 12, the biasing member includes a spring layer 764 disposed between the top and bottom portions or layers of the tang 762.

Figure 13:
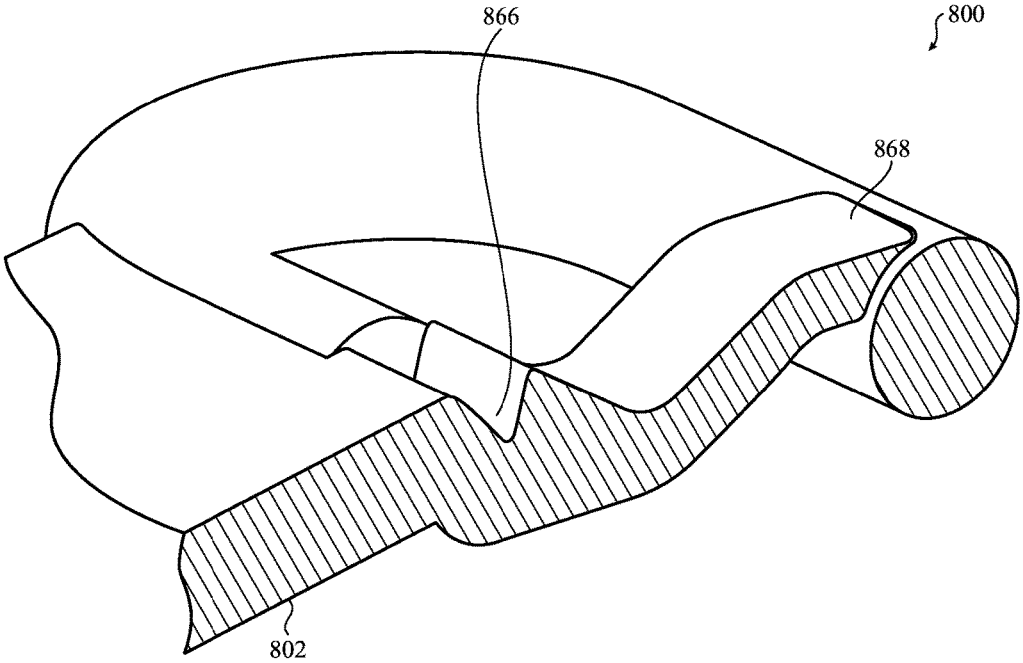
FIG. 13 depicts a cross-sectional view of an alternative buckle mechanism along section C-C, having a tang with a living hinge.

FIG. 13 depicts a cross-sectional view of an alternative buckle mechanism 800 along section C-C, having a tang 868 with a living hinge. The example of FIG. 13 is similar to the integrated tang described above with respect to FIG. 12 in that the tang 868 may be formed as an integral part of the band 802. The tang 868 may or may not include a spring layer, as described above with respect to FIG. 12. Also similar to the previous example, the tang 868 may be molded as part of the same process as the band 802. In some embodiments, the tang 868 is over-molded, co-molded, or otherwise integrated with the material of the band 802.

In the embodiment of FIG. 13, the integrated tang 868 includes a living hinge integrally formed in the tang 868. In some cases, the living hinge is formed from the same material as the tang 868 and/or the band 802, but is configured to repeatedly and reliably flex or bend about a bend line. In general, the living hinge may facilitate repeated opening and closing of the buckle mechanism 800 by allowing the tang 868 to bend about the bend line of the living hinge. As shown in FIG. 13, the living hinge may include a recess 866 formed in a surface of the tang 868 near the junction between the tang 868 and the main body of the band 802. In some embodiments, the recess 866 facilitates the repeated and reliable flexure of the living hinge along the bend line, which may be proximate to the location of the recess 866.

Figure 14:
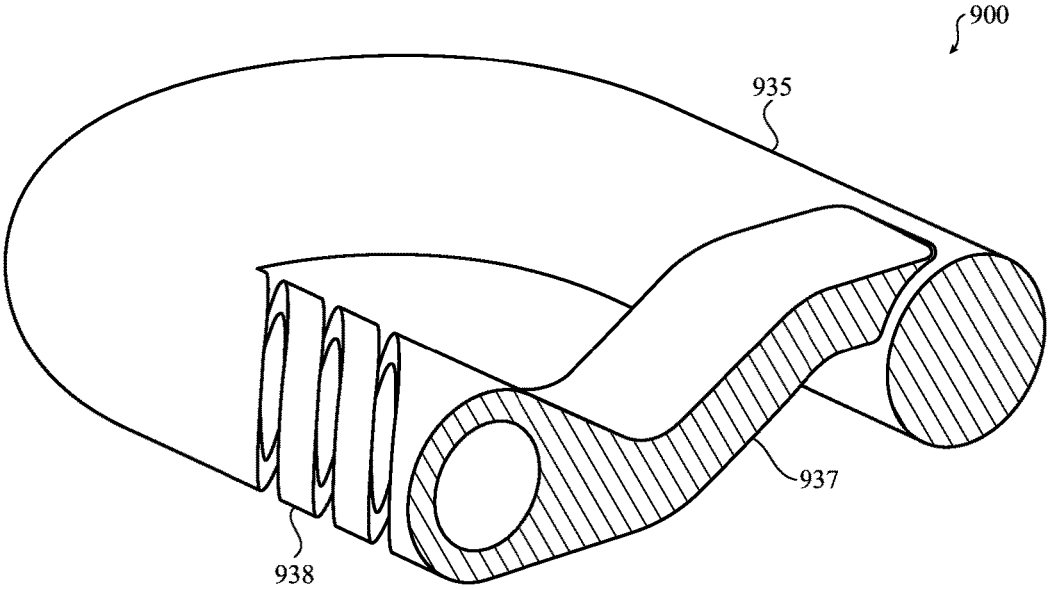
FIG. 14 depicts a cross-sectional view of an alternative buckle mechanism along section C-C, having buckle loop with a spiral portion.

FIG. 14 depicts a cross-sectional view of an alternative buckle mechanism 900 along section C-C, having buckle loop 935 with a spiral portion 938. In the configuration of FIG. 14, the spiral portion 938 of the buckle loop 935 may function as a biasing member by providing a restoring or biasing force on the tang 937. In particular, as the tang 937 is pivoted upward or away from the buckle loop 935, the spiral portion 938 may deflect or twist resulting in a biasing or restoring force being applied to the tang 937. In some embodiments, spiral portion 938 is pre-loaded and provides a biasing force on the tang 937 even when the tang 937 is in the closed position.

As shown in FIG. 14, the spiral portion 938 is integrally formed into the buckle loop 935. The spiral portion 938 may be formed by making a spiral-shaped cut in a portion of the buckle loop 935. The spiral-shaped cut may allow the spiral portion 938 the buckle loop 935 to twist in response to the movement of the tang 937. As the spiral portion 938 twists, it may resist torsional movement of the tang 937 and provide the restoring or biasing force described above. The size and shape of the spiral-shaped cut may determine, in part, the degree of biasing or restoring force to the tang 937. For example, a spiral portion 938 having a spiral cut that continues approximately two times around the buckle loop 935, as shown in FIG. 10, may provide a greater restoring or biasing force as compared to a spiral cut that wraps more than two times around the buckle loop 935. Other aspects of the spiral cut, including width of the cut and angle of the cut, may also determine the amount of restoring or biasing force provided by the spiral portion 938. The cross-sectional view of FIG. 14 depicts one spiral portion 938 formed into one half of the buckle loop 935. However, in a typical embodiment, the buckle loop 935 may include two, symmetrical spiral portions formed in respective halves of the buckle loop 935.

As shown in FIG. 14, the tang 937 is integrally formed into the buckle loop 935 at the end of the spiral portion 938

(or between two spiral portions). In some embodiments, the tang 937 and the buckle loop 935 are formed from a metallic material that is cast or molded into shape. The spiral portion 938 may be formed by laser-cutting or machining a spiral cut within a portion of the buckle loop 935. In some embodiments, the tang 937 may be formed from a separate piece and attached to the spiral portion 938 or other portion of the buckle loop 935.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

We claim:

1. A buckle mechanism for a wearable device, the buckle mechanism comprising:

a tang disposed at an end of a band strap and having an opening;

a buckle loop disposed at the end of the band strap and having a notch feature that is configured to receive an end of the tang when the buckle mechanism is closed;

a biasing member positioned within the opening of the tang and configured to deform when the tang is pivoted away from the notch feature in the buckle loop and to bias the tang toward the notch feature; and a spring bar attached to the end of the band strap and rotatably connecting the tang to the buckle loop, wherein the opening receives the spring bar.

2. The buckle mechanism of claim 1, wherein the tang is configured to pivot about an offset axis that is offset with respect to an axis of the spring bar;

the biasing member is formed from an elastic material disposed between the spring bar and a side wall of the opening; and the elastic material is configured to compress when the tang is pivoted away from the notch feature in the buckle loop.

3. The buckle mechanism of claim 1, wherein the tang is configured to pivot about an offset axis that is offset with respect to an axis of the spring bar; and the biasing member includes the spring bar, which is configured to bend when the tang is pivoted away from the notch feature formed in the buckle loop.

4. The buckle mechanism of claim 1, wherein:

the wearable device is a health monitoring device; and the band strap is configured to attach the health monitoring device to a wrist of a user.

5. A self-closing buckle mechanism comprising:

a bar disposed at an end of a band strap;

a tang defining an opening that receives the bar, the tang configured to pivot about an offset axis that is offset with respect to an axis of the bar; and a buckle loop disposed at the end of the band strap and having a recess that receives an end of the tang, wherein as the tang is rotated away from the recess, a restoring force biases the tang toward the recess.

6. The self-closing buckle mechanism of claim 5, further comprising:

an insert member disposed within the opening, wherein the insert member is configured to generate the restoring force biasing the tang toward the recess.

7. The self-closing buckle mechanism of claim 6, wherein:

the insert member is formed from an elastic material; and the elastic material deforms when the tang is pivoted away from the recess.

8. The self-closing buckle mechanism of claim 6, wherein:

the insert member is formed from two or more elastic materials; and the two or more elastic materials have different elastic properties.

9. The self-closing buckle mechanism of claim 5, wherein:

the buckle loop includes a bearing sleeve portion;

the tang includes a cylindrical portion that pivotally engages the bearing sleeve portion of the buckle loop; and the tang is configured to pivot about the offset axis defined by the cylindrical portion.

10. The self-closing buckle mechanism of claim 5, wherein:

the opening is a clearance fit with respect to the bar; and the bar is configured to bend in response to a rotational movement of the tang.

11. A wearable electronic device comprising:

a body;

a first band strap attached to a first portion of the body;

a second band strap attached to a second portion of the body; and a buckle mechanism configured to attach the first band strap to the second band strap, the buckle mechanism comprising:

a spring bar attached to an end of the first band strap;

a buckle loop engaged to the spring bar; and a tang configured to engage a hole formed in the second band strap to secure the first band strap to the second band strap, wherein:

the tang defines an opening that receives the spring bar;

the tang is configured to pivot about an offset axis that is offset with respect to an axis of the spring bar; and as the tang is rotated, a restoring force biases the tang toward the buckle loop.

12. The wearable electronic device of claim 11, wherein the restoring force maintains engagement of the tang within the hole of the second band strap.

13. The wearable electronic device of claim 11, further comprising:

an elastic material disposed between the spring bar and a side wall of the opening;

wherein the elastic material is configured to deflect in response to the tang being pivoted away from the buckle loop and provide the restoring force.

14. The wearable electronic device of claim 11, wherein the spring bar is configured to bend when the tang is pivoted away from the buckle loop and provide the restoring force.

* * * * *